US010443331B1

(12) United States Patent
Andres et al.

(10) Patent No.: US 10,443,331 B1
(45) Date of Patent: Oct. 15, 2019

(54) SELF-SET FULL BORE FRAC PLUG

(71) Applicant: DIAMONDBACK Industries, Inc., Crowley, TX (US)

(72) Inventors: Robert C Andres, Fort Worth, TX (US); Derrek D Drury, Fort Worth, TX (US)

(73) Assignee: DIAMONDBACK INDUSTRIES, INC., Crowley, TX (US)

( * ) Notice: Subject to any disclaimer, the term of this patent is extended or adjusted under 35 U.S.C. 154(b) by 0 days.

(21) Appl. No.: 16/234,201

(22) Filed: Dec. 27, 2018

(51) Int. Cl.

| | |
|---|---|
| ***E21B 23/06*** | (2006.01) |
| ***E21B 33/129*** | (2006.01) |
| ***E21B 33/128*** | (2006.01) |
| *E21B 43/26* | (2006.01) |

(52) U.S. Cl.
CPC ..... *E21B 23/065* (2013.01); *E21B 33/128* (2013.01); *E21B 33/1293* (2013.01); *E21B 43/26* (2013.01)

(58) Field of Classification Search
CPC ..... E21B 23/065
USPC ..... 166/135
See application file for complete search history.

(56) References Cited

U.S. PATENT DOCUMENTS

| | | | |
|---|---|---|---|
| 2,618,343 A | 11/1952 | Conrad | |
| 3,082,824 A | 3/1963 | Taylor et al. | |
| 4,898,245 A | 2/1990 | Braddick | |
| 5,024,270 A * | 6/1991 | Bostick | E21B 23/065 160/120 |
| 5,211,224 A | 5/1993 | Bouldin | |
| 6,167,963 B1 | 1/2001 | McMahan | |
| 6,257,331 B1 | 7/2001 | Blount | |
| 6,536,532 B2 | 3/2003 | Doane | |
| 7,017,672 B2 | 3/2006 | Owen, Sr. | |
| 7,325,612 B2 | 2/2008 | Hendrickson et al. | |
| 8,056,638 B2 | 11/2011 | Clayton | |
| 8,113,276 B2 | 2/2012 | Greenlee et al. | |
| 8,235,102 B1 | 8/2012 | Robertson | |

(Continued)

OTHER PUBLICATIONS

Downhole Technologies, LLC., Boss Hog Frac Plug Configurations, Online Brochure, 2018.

(Continued)

*Primary Examiner* — Taras P Bemko
(74) *Attorney, Agent, or Firm* — Mark W Handley; Handley Law Firm, PLLC

(57) ABSTRACT

A frac plug has a mandrel (42) about which slips (48) and (56), conical rings (46) and (54), and a seal element (52) are disposed in conventional fashion. A setting rod (32) has an upper end secured to a firing head (16), extends through the mandrel (42), and has a lower end secured to a shoe (62) located at the bottom of the mandrel (42). A power charge (110) is located in an annular-shaped space (106) extending between the mandrel (42) and the setting rod (32). Flow ports (90) extend through the mandrel (42) to a barrel piston (94) disposed around the exterior of the mandrel (42). During setting, the setting rod (32) will release from the shoe (62) at a predetermined force, allowing retrieval of the setting rod (32) and the firing head (16) separate from the frac plug (14). The firing head (16) has flow passages (34) for passing ignition gasses from the primary igniter (28) to the secondary igniter (108) with the flow passages (34) extending at an angle to a longitudinal axis (30).

20 Claims, 3 Drawing Sheets

(56) References Cited

U.S. PATENT DOCUMENTS

| | | | |
|---|---|---|---|
| 8,256,521 | B2 | 9/2012 | Swor |
| 9,482,069 | B2 | 11/2016 | Powers |
| 9,810,035 | B1 | 11/2017 | Carr et al. |
| 10,000,991 | B2 | 6/2018 | Harris et al. |
| 2014/0083677 | A1 | 3/2014 | Stormo |

OTHER PUBLICATIONS

Halliburton Company, Drillable Bridge and Frac Plugs, Online Brochure, 2018.
Schlumberger Limited, Big-Bore Frac Plug, Online Brochure, 2018.

* cited by examiner

SELF-SET FULL BORE FRAC PLUG

TECHNICAL FIELD OF THE INVENTION

The present invention is related to downhole oil tools, and in particular to frac plugs, bridge plugs and packers for sealing well casing, and to hydraulic setting tools.

BACKGROUND OF THE INVENTION

Oil and gas wells are drilled into earth formations, first creating a borehole and then running and cementing casing in the borehole. Well tools such as bridge plugs, packers, cement retainers and frac plugs are often run into cased wells and set in casing to seal sections of wells. Conventional well tools providing well casing sealing assemblies typically comprise a packer having one or more elastomeric sealing elements which are squeezed between a packer mandrel and the casing, and held in place by one or more slip assemblies which are wedged between conical sleeves of the packers and the casing. The packers are configured for use as bridge plugs, tubing packers, cement retainers, and frac plugs. The packer mandrels provide a central body on which various components are mounted. The mandrel is attached to a stationary portion of the setting tool and held in a fixed position, and the setting sleeve typically extends around the mandrel and is stroked downward against an uppermost sleeve of the well tool being set. The upper sleeve will then move downward toward a lower end of the mandrel, pushing anchor slips over conical elements and compressing an elastomeric seal element between the mandrel and the casing. During setting of the casing seal device, shear pins will be sheared to release the setting tool from the set well tool so that the setting tool may be retrieved from the well and be redressed for repeated later use. U.S. Pat. No. 3,082,824, invented by F. A. Taylor et al and issued Mar. 26, 1963 shows use of a machined weak point to connect a setting rod to the lower end of a well tool mandrel, with the weak point releasing when the well tool is set to release the setting rod and firing head from the well tool.

Modern frac plugs are used for sealing sections of well casing and selectively applying pressure to multiple formation production zones for sequentially pumping treatment fluids and frac proppants into the various formations. After treatment, the frac plugs are often drilled out so that fluids produced from the treated production zones can be produced from the well. Conventional frac plugs are made of cast iron and composite materials which are more easily and more rapidly drilled than plugs made of steel. Recently developed frac plugs are made of materials which dissolve when exposed to time, temperature and fluids in the well, avoiding drill-out. Frac plugs and packers often have an upper end which is formed to provide a ball seat for sealingly engaging with drop balls. Drop balls are often dissolvable and include dissolvable frac balls which are dropped onto the ball seats. After well treatment at a zone above a particular frac plug, the frac ball will dissolve after exposure to time, temperature and fluids in the well, and fluids may be produced from lower production zones through the central bore in the frac plug without the need to drill-out the frac plug.

Frac plugs have been set with tubing and with gas powered setting tools. Conventional gas powered setting tools have power charge chambers in which power charges formed of flammable solids are burned to generate pressurized gases which move one or more pistons to forcibly set the well tool being run within the well. One such setting tool is shown in U.S. Pat. No. 2,618,343 issued to Martin B. Conrad on Nov. 18, 1952. Conventional setting tools use hydraulic oil located between a first piston disposed in a first cylinder and a second piston disposed in a second cylinder. The first piston in the first cylinder is pushed directly by power charge gases and in turn pushes the hydraulic fluid, which then pushes the second piston in the second cylinder. The second piston is then typically connected by a rod and linkage to a setting sleeve for pushing against and setting the well tool in the casing. Recently a disposable setting tool was developed in which the flammable solids are used for stroking the setting tool, without use of hydraulic fluids, as shown in U.S. Pat. No. 9,810,035, invented by Jimmy L. Carr et al., and issued to Diamondback Industries, Inc. on Nov. 7, 2017. The prior art has also included bridge plugs in which a setting tool is built into the bridge plug, such as U.S. Pat. No. 7,017,672 which was invented by Harrold D. Owen, Sr., and issued on Mar. 28, 2006.

SUMMARY OF THE INVENTION

A self-set full bore frac plug is disclosed which is gas operated for setting in well casing and used in fracturing operations in oil and gas wells. The frac plug is self-setting in that it does not require a separate setting tool for use, but instead a setting tool is integrated into the frac plug. The frac plug has a mandrel which is tubular shaped and has an elastomeric seal element extending around an exterior of the mandrel. One or more conical elements and associated slips are provided for securing the frac plug within a well casing. Each conical element is preferably provided by a ring having conically shaped exterior over which the associated slips are moved and wedged between the casing and the conical element to secure the mandrel within the casing. Movement of the slips also moves an associated conical element to squeeze the elastomeric element between the mandrel and the casing, sealingly engaging there-between. A firing head is mounted to the upper end of the mandrel. A setting rod extends from the firing head, through the mandrel, and to a shoe located at the lower end of the mandrel. The setting rod has a first end and a second end; the first end secures the firing head to the upper end of the mandrel, and the second end secures a shoe to the lower end of the mandrel. Setting the frac plug separates the setting rod from the shoe and frees the firing head and setting rod for removal from the frac plug and the well.

The mandrel has a bore with an interior profile which is preferably fully open and of uniform circumference for the full length of the mandrel. A power charge is located within the mandrel, in an annular-shaped space extending between the setting rod and the mandrel. The power charge is preferably a propellant formed of a combination of combustible material and an oxidizer, which is mixed with a two part epoxy and molded into a solid, tubular-shape which fits within the annular-shaped space located between the setting rod and the mandrel. In other embodiments the power charge may be a loose powder or pliant material which is packed directly into the annular-shaped space between the setting rod and the mandrel, and may also include materials which will harden after packing, such as the two-part epoxy. A secondary igniter is preferably located atop the power charge when disposed in the frac plug. The power charge is dry fired in the frac plug, that is, the frac plug does not use hydraulic fluid such as oil for applying hydraulic pressure to set the frac plug but instead uses only the gas generated by burning the power charge.

The mandrel has an outer periphery which defines an upper section, an intermediate section, a seal boss which is annular-shaped, and a lower section. The upper terminal end of the mandrel is formed to provide a ball seat for receiving a drop ball. The lower terminal end of the mandrel is formed for sealingly receiving the shoe. A barrel piston extends around the mandrel and is slidably moveable over the mandrel during setting of the frac plug. The barrel piston has a tubular body with an enclosed upper end, a central portion with a uniform interior circumference for slidably receiving the intermediate section, the seal boss and the lower section of the mandrel. An annular-shaped space is defined to extend between the central portion of the barrel piston and the mandrel. The upper end of the barrel piston has a bore for slidably receiving the intermediate section of the mandrel. A first seal extends between the bore in the enclosed upper end of the piston barrel and the intermediate section of the mandrel for sealing an upper terminal end of the annular-shaped space. A second seal extends between the barrel piston and the seal boss for sealing between an upper portion and a lower portion of the annular-shaped space. A third set of seals extends between a seal ring, the lower end of the piston barrel and the lower end of the mandrel. The seal ring is preferably secured in fixed relation to the lower end of the piston barrel and slidably moveable over the lower section of the mandrel. Flow ports extend between the interior of the mandrel and the upper portion of the annular-shaped space extending between the piston barrel and the exterior of the mandrel.

The frac plug is set by igniting the power charge, which burns to generate pressurized gas and stroke the barrel piston over the lower section, the seal boss and a lower portion of the intermediate section of the mandrel. The barrel piston moves upward relative to the stationary mandrel to set the slips on respective conical rings to secure the frac plug within well casing and to squeeze the elastomeric seal element between the well casing and the mandrel, sealing there-between. The setting rod is then separated from the shoe, separating the setting rod from the shoe such that the setting rod and firing head are released from the frac plug for removal from the well. Once the shoe and the setting rod are separated, the shoe will fall from the lower terminal end of the mandrel. Retrieval of the firing head and the setting rod leaves the interior bore of the mandrel fully open, with the ball seat located on the upper terminal end of the mandrel.

DESCRIPTION OF THE DRAWINGS

For a more complete understanding of the present invention and the advantages thereof, reference is now made to the following description taken in conjunction with the accompanying Drawings in which FIGS. 1 through 5 show various aspects for a self-set full bore frac plug made according to the present disclosure, as set forth below:

FIG. 1 is a longitudinal section view of a self-set full bore frac plug disposed in a run-in condition and located within well casing;

FIG. 2 is a longitudinal section view of the self-set full bore frac plug while being set within the well casing;

FIG. 4 is a longitudinal section view of an alternative embodiment for the self-set full bore frac plug in a run in condition and located within the well casing; and FIG. 5 is a longitudinal section view of the alternative self-set full bore frac plug in a run in set condition within the well casing.

DETAILED DESCRIPTION OF THE INVENTION

Figure 1:
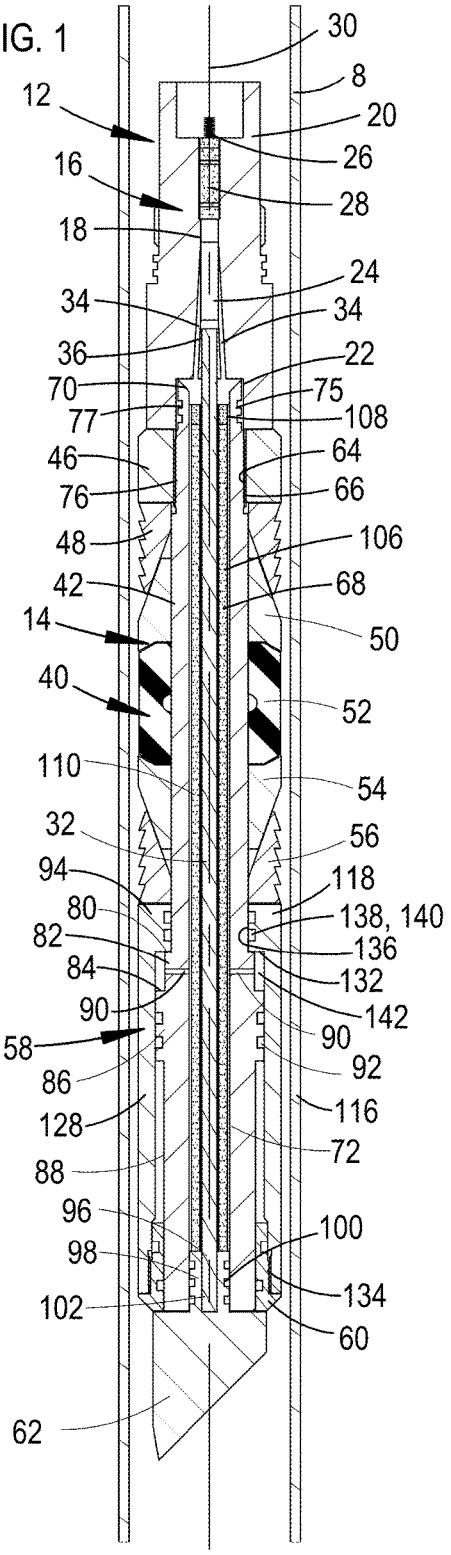

Referring to the Figures, FIG. 1 is a longitudinal section view of a self-set full bore frac plug 14 disposed in a run-in condition and located within well casing 8. The frac plug 14 is self-setting in that it does not require a separate setting tool for use, but instead a setting tool is integral with the frac plug 14. The frac plug 14 has a mandrel 42 which provides a central, stationary member for the frac plug 14, extending the full length of the frac plug 14, from a firing head 16 to the lowermost end of the frac plug 14. The mandrel 42 is tubular shaped and preferably extends concentrically around a central longitudinal axis 30 of the frac plug 14. A ball seat 70 is formed on the upper end of the mandrel 42 for sealingly engaging with drop balls. The frac plug 14 further includes lock ring 46 and a seal and anchor assembly 40. The seal and anchor assembly 40 includes an upper conical sleeve 50, and upper slips 48 which slidably engage with the upper conical sleeve 50 to anchor an upper end of the seal assembly 40 of the frac plug 14 to the well casing 8. Lower slips 56 slidably engage a lower conical sleeve 54 to anchor a lower end of the seal and anchor assembly 40 of the frac plug 14 to the casing 8. An elastomeric seal element 52 is disposed between the upper conical sleeve 48 and the lower conical sleeve 54 for compressing there-between to seal between an exterior surface of the plug mandrel 42 and the interior surface of the casing 8.

A firing head 16 is secured to an upper end of the mandrel 42 by a setting rod 32. The setting rod 32 is secured to a shoe 62 located on the lower end of the mandrel 42 and the frac plug 14, preferably by acme threads. The firing head 16 and the setting rod 32 are preferably concentrically disposed around the longitudinal axis 30. The firing head 16 has an upper pin end 20 for receiving an adapter head for running on wireline, tubing, or the like. The firing head 16 has a contact pin 26 connecting to an igniter 28. The igniter 28 is located in an interior bore 18 of the firing head 16, which connects a central portion 24 of an ignition pathway to two flow passages 34 which extend at an angle to a longitudinal axis 38, preferably at a three degree angle. The flow passages 34 provide a fluid communication pathway between the primary igniter 28 and the secondary igniter 108 for igniting the power charge 110. The firing head 16 further includes a lower box end for receiving an upper pin end 75 of the mandrel 42. The lower box end of the firing head 16 includes seals 44. A lower terminal end 48 engages the top of a lock ring 46. In other embodiments, the firing head adapter 16 may be replaced by a firing head adapter (not shown) which fits directly to the upper pin end 75 of the mandrel 42 in a sliding engagement and which may be secured to an industry standard firing head (not shown).

The lock ring 46 has an annular-shaped body which is concentric with the longitudinal axis 30. The lock ring 46 has interior threads 64 which are threadingly secured to threads 66 formed in the exterior of the upper end of the mandrel 42. The lock ring 46 has an upper end and a lower end, the upper end abuts the lower end of the firing head 16 and the lower end provides a stop for engaging a terminal end of the upper conical sleeve 50.

The mandrel 42 has an exterior profile 74 with the upper pin end 75, an intermediate section 78, a transition section 79, and a lower section 88. The upper pin end 75 has a seal section 77 and a threaded section 76. The seal section 77 seals between the exterior of the pin end 75 and interior of the firing head 16. The threaded section 76 secures the lock ring 46 to the upper pin end and provides a stop for the lower end of the firing head 16 and the terminal upper end of the seal and anchor assembly 40, extending radially outward from the pin end 75. The seal and anchor assembly 40 are slidably secured to the intermediate section 78 of the exterior profile 74. The transition section includes a first annular shaped boss 82 and a second annular shaped boss 86 disposed beneath the first annular shaped boss 82. The first annular shaped boss 82 has a larger outer diameter than the intermediate section 78, providing an upward facing, first annular shoulder 80. The shoulder 80 provides a stop for the barrel piston 94, being of a smaller diameter than the bore 136 of the enclosed upper end 118 of the barrel piston 58. The second annular shaped boss 86 provides an annular-shaped seal boss which is of a larger outer diameter than the outer diameter first annular shaped boss 82, and has seals 92 which sealingly engage between the second boss 86 and the interior of the tubular body of the barrel piston 94. A lower section 88 has an outer diameter which is smaller than the outer diameter of the second boss 86 and larger than the outer diameter of the intermediate section 78, and preferably the same size as the outer diameter of the first boss 82. Flow ports 90 extend through the sidewall of the mandrel 42 between the inwardly extending boss 94 and the outwardly extending boss 86, preferably extending radially outward from the central bore 68, through the first boss 82, between the shoulder 80 and the second boss 86. The lower section 88 of the mandrel 42 preferably has a solid body of cylindrical shape which is preferably of uniform circumference and defines a seal surface that provides a bearing surface for engaging the bore 136 of the enclosed lower end 134 of the barrel piston 58.

A barrel piston 58, or piston sleeve, is slidably mounted to the mandrel 42. The barrel piston 58 has a tubular-shaped body 116 which is concentric with the longitudinal axis 30, and has an enclosed upper end 118, a central portion 128 and an open lower end 134. The enclosed upper end 118 of the barrel piston 58 has the bore 136 extending centrally through the end 134, defining an annular-shaped boss 94 which extends inwardly from the upper end of the barrel piston 58. The bore 136 provides an interior bearing surface for slidably engaging the exterior surface of the lower section 96 of the mandrel 42. Seal gland grooves 138 are formed into the bore 136 for receiving O-rings 140 (not shown). A central portion 128 of the barrel piston 58 has an interior surface of uniform circumference and defines an outer cylindrical portion of the annular-shaped space 142. The annular space 142 has an end face 132, which is annular-shaped and which the pressure within the space 142 acts against when the tool is operated to move from the run-in position to the set position. The lower end 134 of the barrel piston 58 has a threaded section with interior threads which threadingly engage the exterior threads of a lower end portion of a seal ring 60 to secure the lower end 134 of the barrel piston 58 to the seal ring 60.

The seal ring 60 is a lower sleeve which provides both a seal for sealing between the lower open end 134 of the barrel piston 58 and the lower end 134 of the mandrel 42 and a bearing for engaging the lower end of the mandrel 42. A lower end portion 146 of the seal ring 60 has a larger outside diameter than an upper end portion 148. An interior bore 150 of uniform circumference extends through the lower ring 60 and is sized for slidably extending over the lower end 88 of the mandrel 42 to provide a bearing. An exterior of the lower ring 60 has exterior threads for securing to interior threads formed on the lower end 134 of the barrel piston 58.

The power charge 110 is contained within the mandrel 42 of the frac plug 14 and powers the barrel piston 58 to set the slips 48, 54 and expand a seal element 52. The power charge 110 is preferably a mixture of propellant and epoxy which is cured into solid form in the shape of a cylindrical sleeve. The power charge 110 preferably extends substantially the full length of the frac plug 14, but in other embodiments may be of shorter lengths with a spacer or stop located beneath the power charge. The power charge 110 extends around a setting rod 32 and interiorly within the central bore 68 of the mandrel 42. Power charges are constructed of propellant mixtures composed of carefully controlled combustible elements containing an oxidizer which when ignited will begin a slow burn lasting approximately thirty seconds. The gas derived from a burning power charge propellant mixture gradually builds up to high pressures and causes a setting tool to stroke, setting a downhole tool in a well. For the present frac plug, internal pressures range from 13,500 psi to 14,000 psi and approximately 28,000 pounds of force is developed in stroking the barrel piston 58 and applied to separate the setting rod 32 to the shoe 62.

A propellant for the power charge 110 is preferably provided by a combination of combustible materials and an oxidizer, such as sodium nitrate, Pyrodex, which is a smokeless black powder substitute, and wheat flour. The propellant mixture 16 of the power charge 110 is formed of a mixture of the propellant and a binder. The binder is preferably a two part slow cure epoxy composed of an epoxy resin and an epoxy hardener which will harden to a solid in twenty-four hours, locking the propellant mixture 16 into the rigid, solid form. To provide the power charge, the propellant mixture 16 is preferably mixed to a dough-like form, of a consistency similar to cookie dough, which is preferably tightly packed and molded into a continuous form, and then cured to provide a solid mass for placing in the frac plug 14, or is packed in uncured form directly into the annular-shaped space 106 in the frac plug 14. The power charge 110 may be provided either with or without a packing sleeve. A packing sleeve is typically formed of a paper type fiberboard material which is wound around a mandrel using three to four layers of a sheet of fiberboard material. The fiberboard material is wound to three or four layers, forming a three ply or four ply tube structure. A packing mandrel may be inserted into the packing sleeve and then removed after the propellant mixture cures to a hardened form. The packing sleeve may be removed from the power charge 110 prior to use or may be left in place during use. The power charge 110 will typically include from three hundred grams to eight hundred grams of propellant.

A secondary igniter 108 is preferably annular-shaped, and disposed on the top of the power charge 110. The secondary igniter 32 used for the power charge 110 is preferably formed of an ignition material which includes sixty to seventy percent Pyrodex (which is a smokeless black powder substitute), ten percent potassium nitrate, three percent graphite, carbon black, and a binder, which are packed together with the binder to form a rigid unit. Preferably, the two part epoxy used as a binder for the power charge propellant is used as a binder for the ignition materials of the secondary igniter 108. The secondary igniter 108 may be embedded in the mixture providing the power charge, located in the upper end of the power charge 110 when mounted in the frac plug 14. The secondary igniter 32 is preferably annular shaped and covers the upper end of the power charge 110.

Figure 2:
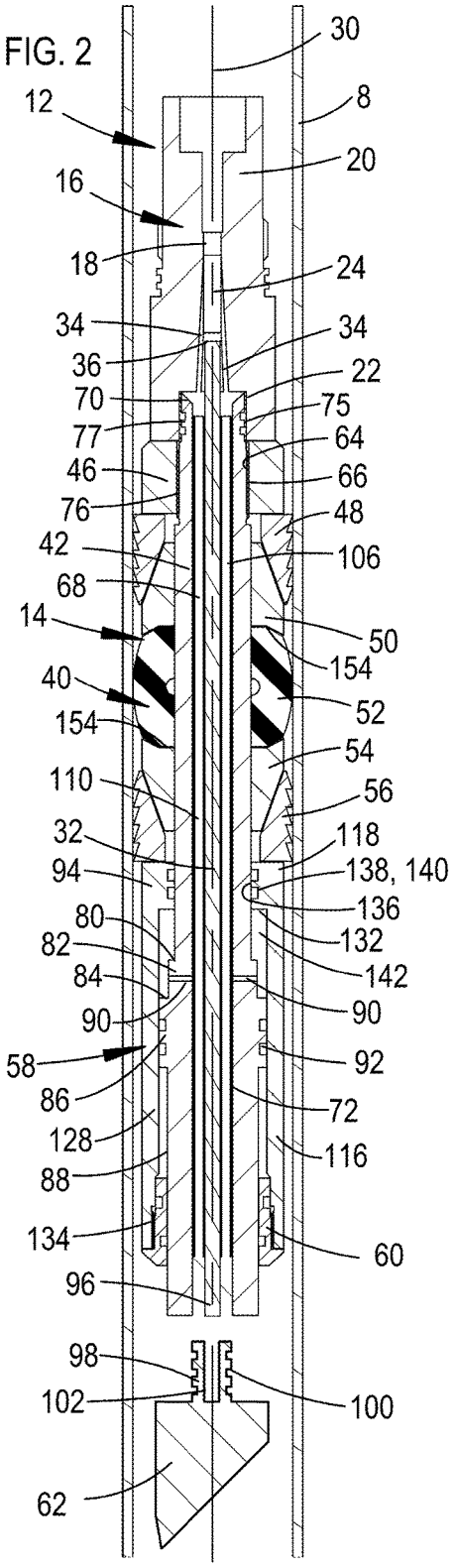

FIG. 2 is a longitudinal section view of the self-set full bore frac plug 14 while being set within well casing 8. The primary igniter 28 is fired by applying electric current to the contact pin 26 of the firing head 16, with the electric current provided from a connector head of either a tubing or a wireline string, or the like (not shown) connected to the firing head 16 in conventional fashion. The igniter 28 will burn, passing hot gasses and a flame through the flow passages 34 and igniting the secondary igniter 108. The secondary igniter 108 will then cause the power charge 110 to burn and generate high pressure gases which pass through the two ports 90 and build pressure within the space 142 located between the barrel piston 58 and the mandrel 42. Force from the pressures of the generated gases will press against an inner end face 132 of the annular-shaped boss 94 of the barrel piston 58, moving the barrel piston 58 upwards to set the frac plug 14. This compresses the elastomeric seal element 52 between the two facing concave surfaces 154 of the upper conical ring 50 and the lower conical ring 54, squeezing the seal element 52 between the well casing 8 and the mandrel 42 and preventing well fluids from passing there-between. Moving the piston sleeve 58 upwards sets the slips 48 and 56 on the conical ring 50 and the conical ring 54, respectively, to anchor the frac plug 152 in the well casing 8. The pressure from the power charge 110 will also separate the shoe 62 from the setting rod 32, and venting the gas pressure from the spent power charge 110 from within the frac plug 14. In the preferred embodiment, the threads on the terminal end section of the setting rod 32 will shear from engagement with threads formed into a blind hole in the top of the shoe 62 at the preselected force. Acme threads are preferablyused and shear at a predetermined force. The gas pressure and gravity will push the shoe 62 out of the bottom of the mandrel 42, leaving the central bore 68 of the frac plug mandrel 42 fully open. The setting rod 32 and the firing head 16 will be removed from within the mandrel 42 and the well. The ball seat 70 will be facing upwards on the upper end of the mandrel 42 for receiving a drop ball.

Figure 3A:
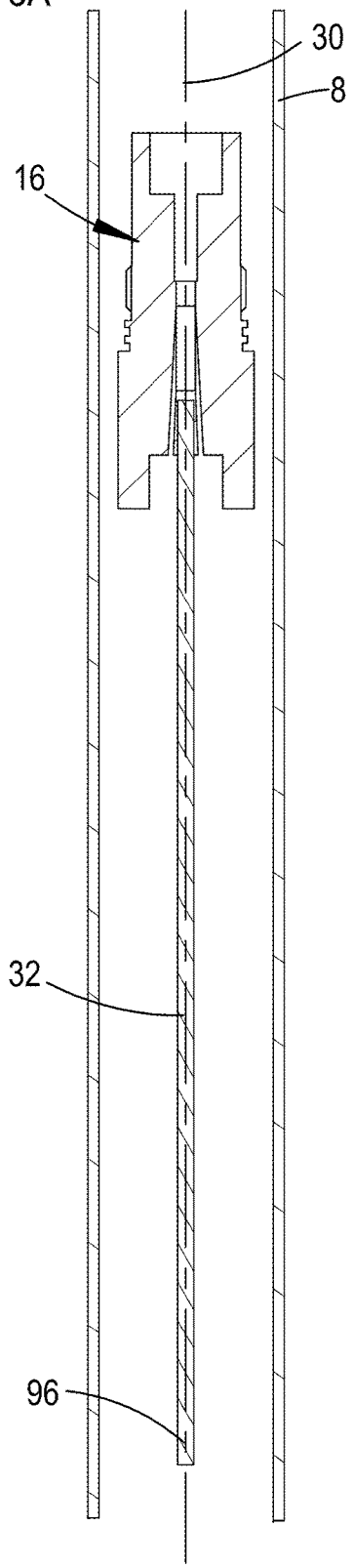
FIG. 3A and FIG. 3B together provide a longitudinal section of the self-set full bore frac plug after being set and the firing head and setting rod have been removed from the frac plug.
Figure 3B:
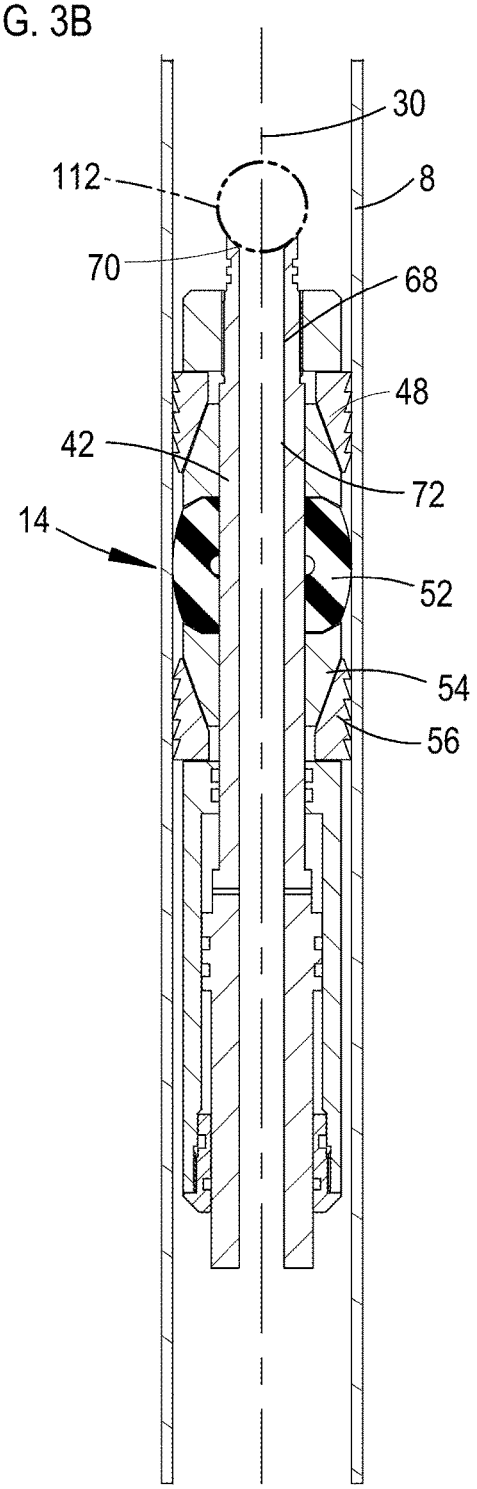

FIG. 3A and FIG. 3B together provide a longitudinal section of the self-set full bore frac plug 14 after being set in the well casing 8. The firing head 16 and setting rod 32 are being removed from the frac plug 14. A drop ball 112 is shown in phantom for seating and sealingly engaging on the ball seat 70. The drop ball 112 is preferably dropped into the well after the firing head 16 and the setting rod 32 are removed from the well.

Figure 4:
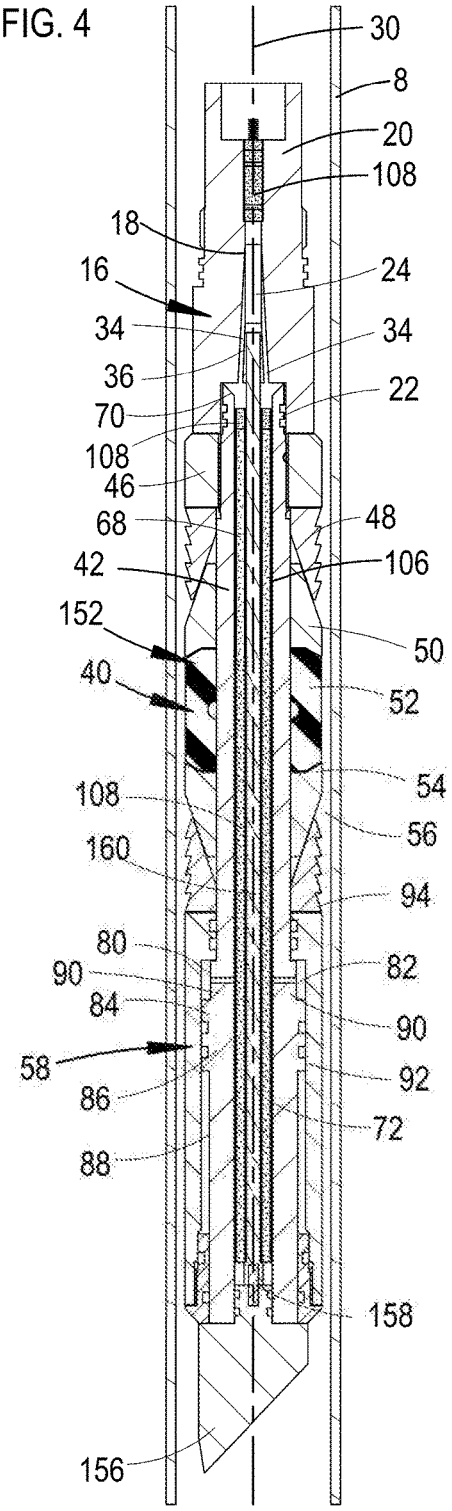

FIG. 4 is a longitudinal section view of an alternative embodiment, self-set full bore frac plug 152 is shown in a run in condition and located within the well casing 8. The frac plug 152 preferably uses the same components as the frac plug 14, except that the shoe 156 and the setting rod 160 are used in place of the setting rod 32 and the shoe 62 of the frac plug 14. The shoe 156 and the setting rod 160 are coupled together by a weak point 158. The weak point 158 has external threads, preferably acme, and the lower terminal end of the setting rod 160 and the upper terminal end of the shoe 156 each have threaded blind holes for receiving and threadingly securing to the weak point 158. Unlike the setting rod 32 and the shoe 64 of FIGS. 1-3B, the threads securing the weak point 158 to the setting rod 160 and the shoe 156 will not shear before the tensile strength of the weak point 158 is exceeded and breaks into two parts 158A and 158B, shown in FIG. 5.

Figure 5:
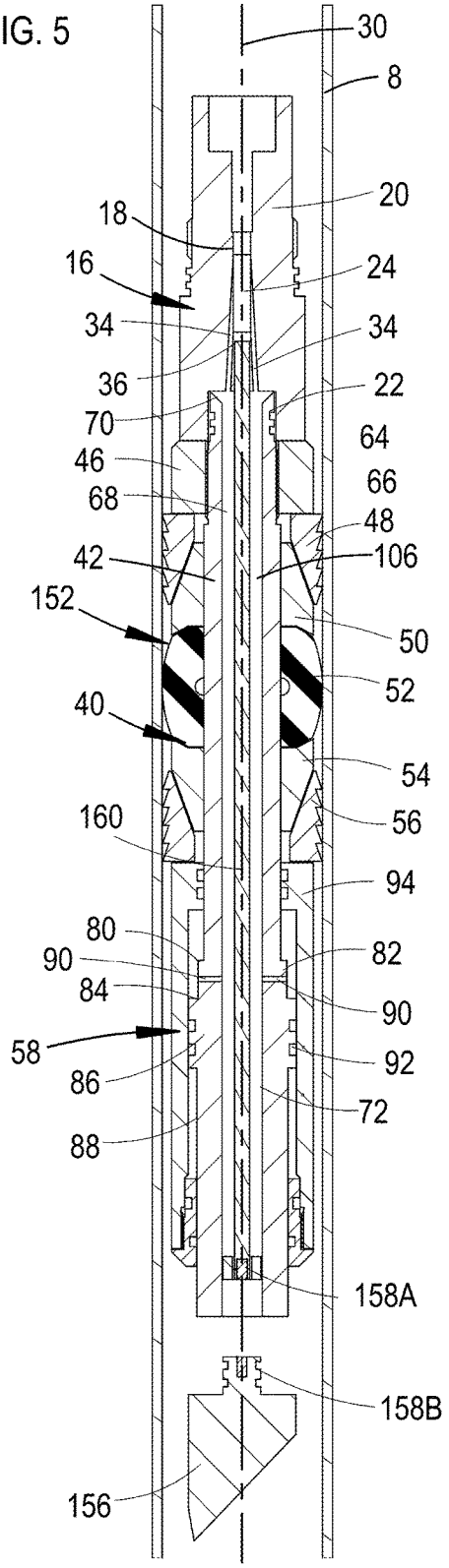

FIG. 5 is a longitudinal section view of the alternative self-set full bore frac plug 152 disposed in a set condition within the well casing 8. The primary igniter 28 and the secondary igniter 108 have been activated and the power charge 110 has been burned, with the resulting gas pressures pushing the piston sleeve 58 upwards. This compresses the elastomeric seal element between the two facing concave surfaces of the upper conical ring 50 and the lower conical ring 54 and sealing between the well casing 8 and the mandrel 42. Moving the piston sleeve 58 upwards sets the slips 48 and 56 on the conical ring 50 and the conical ring 54, respectively, to anchor the frac plug 152 in the well casing 8.

The present disclosure provides a self-setting frac plug with a fully open mandrel. The upper terminal end of the mandrel is a ball seat for receiving a drop ball. The frac plug has a setting tool integrally formed with the frac plug, using common components there-between. A setting rod extends from a firing head, through the mandrel and to a shoe located at a lower terminal end of the mandrel. The setting rod is secured to both the firing head and the shoe, and setting the frac plug separates the setting rod from the shoe. A power charge for setting the frac plug is preferably annular-shaped and located in the annular space extending between the setting rod and the mandrel. Ports extend through the mandrel for passing gases generated from burning the power charge from the interior of the mandrel, and to a barrel piston to set the frac plug. A secondary igniter is located on top of the power charge. A primary igniter is located in the firing head and two passages extend at an angle to a longitudinal axis of the frac plug to provide fluid communication between the primary igniter and the secondary igniter, with a connection between the setting rod and the firing head disposed longitudinally between the primary and secondary igniters.

Although the preferred embodiment has been described in detail, it should be understood that various changes, substitutions and alterations can be made therein without departing from the spirit and scope of the invention as defined by the appended claims.

What is claimed is:

1. A packer for setting in a well casing comprising:

a mandrel of a tubular shape having an upper section, an intermediate section and a lower section, said upper section configured for securing to a firing head, said intermediate section having a seal and anchor assembly disposed thereon, and said lower section having at least one outwardly extending annular-shaped boss which extends with a larger diameter than said intermediate section, wherein said mandrel has a central bore which defines a longitudinal axis of said packer;

said seal and anchor assembly including an elastomeric seal assembly having at least one seal element which is disposed around said mandrel, and at least one anchor assembly, wherein said at least one anchor assembly is disposed adjacent to said elastomeric seal assembly and has at least one conical sleeve and slips for engaging said slips over said at least one conical sleeve to anchor the packer within the well casing;

a piston barrel having a tubular-shaped body extending around said mandrel, from said intermediate section to said lower section and extending over said outwardly extending, annular-shaped boss, said piston barrel having an enclosed upper end with a bore extending there-through and defining an inwardly extending annular-shaped boss which provides an interior bearing surface for slidably engaging said intermediate section of said mandrel;

one or more flow ports extending through a sidewall of said mandrel, from said central bore to an exterior of said mandrel, said one or more flow ports extending between said outwardly extending, annular shaped boss of said mandrel and said inwardly extending, annular shaped boss of said piston barrel;

a firing head for securing to said upper section of said mandrel;

a setting rod secured to said firing head, extending through said mandrel, and releasably secured to a shoe disposed at a lower terminal end of said mandrel, wherein said setting rod releases from being secured to said shoe at a predetermined force; and a power charge disposed within said central bore of said mandrel, extending between said setting rod and said mandrel, said power charge being ignitable to burn and generate gases at pressures for pushing said piston barrel upwards to set said seal and anchor assembly, with said at least one seal element sealingly extending between the well casing and said mandrel and said slips wedged between said at least one conical sleeve and well casing.

2. The packer according to claim 1, further comprising an igniter disposed atop said power charge disposed in said central bore, and extending between said setting rod and said mandrel.

3. The packer according to claim 1, wherein said firing head contains an igniter disposed above a connection which secures said firing head to said setting rod, and one or more igniter flow passages extend from said igniter and into fluid communication with a space extending between said setting rod and said mandrel.

4. The packer according to claim 3, wherein said one or more igniter flow passages extend aside of said connection which secures said firing head to said setting rod.

5. The packer according to claim 4, wherein said one or more igniter flow passages extend at a three degree angle to said longitudinal axis and directly extend to said space extending between said setting rod and said mandrel.

6. The packer according to claim 1, wherein said mandrel has a full open bore of constant diameter extending through said upper section, said intermediate section and said lower section.

7. The packer according to claim 1, wherein said at least one conical sleeve has a concave sidewall which extends generally transverse to said longitudinal axis for matingly engaging a side of said at least one seal element.

8. The packer according to claim 1, wherein said power charge is annular-shaped and of solid form.

9. The packer according to claim 1, wherein said setting rod is secured to said shoe with threads and said threads shear at said predetermined force to release said setting rod from said shoe.

10. The packer according to claim 1, wherein said setting rod is secured to said shoe with a weak point which separates at said predetermined force to release said setting rod from said shoe.

11. A frac plug for setting in a well casing comprising:

a mandrel being of a tubular, generally cylindrical shape defining an upper section, an intermediate section and a lower section, said upper section configured for securing to a firing head, said intermediate section having a seal and anchor assembly disposed thereon, and said lower section having at least one outwardly extending annular-shaped boss which extends with a larger diameter than said intermediate section, wherein said mandrel has a central bore which defines a longitudinal axis of said frac plug;

said seal and anchor assembly including an elastomeric seal assembly having at least one seal element which is disposed around said mandrel, and an upper anchor assembly and a lower anchor assembly, wherein said upper anchor assembly is disposed above said elastomeric seal assembly and said lower anchor assembly is disposed beneath said elastomeric seal assembly, each of said upper and lower anchor assemblies having a respective conical sleeve and slips for engaging said slips over said conical sleeves to anchor the frac plug within the well casing;

a piston barrel having a tubular-shaped body extending around said mandrel, from said intermediate section to said lower section and extending over said outwardly extending, annular-shaped boss, said piston barrel having an enclosed upper end with a bore extending there-through and defining an inwardly extending annular-shaped boss which provides an interior bearing surface for slidably engaging said intermediate section of said mandrel;

flow ports extending through a sidewall of said mandrel, from said central bore to an exterior of said mandrel, said flow ports extending between said outwardly extending, annular-shaped boss of said mandrel and said inwardly extending, annular-shaped boss of said piston barrel;

a firing head for securing to said upper section of said mandrel;

a setting rod secured to said firing head, extending through said mandrel, and releasably secured to a shoe disposed at a lower terminal end of said mandrel, wherein said setting rod releases from being secured to said shoe at a predetermined force; and a power charge disposed in an annular-shaped space extending between said setting rod and said mandrel, said power charge being ignitable to burn and generate gases at pressures for pushing said piston barrel upwards to set said seal and anchor assembly, with said at least one seal element sealingly extending between the well casing and said mandrel and said slips wedged between said respective ones of said conical sleeves and the well casing.

12. The frac plug according to claim 11, further comprising an annular-shaped igniter disposed atop said power charge disposed in an annular-shaped space extending between said setting rod and said mandrel.

13. The frac plug according to claim 11, wherein said firing head contains an igniter disposed above a connection which secures said firing head to said setting rod, and one or more igniter flow passages extend from said igniter and into fluid communication with said annular-shaped space extending between said setting rod and said mandrel.

14. The frac plug according to claim 13, wherein said one or more igniter flow passages extend aside of said connection which secures said firing head to said setting rod.

15. The frac plug according to claim 14, wherein said one or more igniter flow passages extend at a three degree angle to said longitudinal axis and directly extend to said annular-shaped space extending between said setting rod and said mandrel.

16. The frac plug according to claim 11, wherein said mandrel has a full open bore of constant diameter extending through said upper section, said intermediate section and said lower section.

17. The frac plug according to claim 11, wherein said conical sleeves each have concave sidewalls which extend generally transverse to said longitudinal axis for matingly engaging the sides of respective ones of an uppermost end and a lowermost end of said at least one seal element.

18. The frac plug according to claim 11, wherein said power charge is annular-shaped and of solid form.

19. The frac plug according to claim 11, wherein said setting rod is secured to said shoe with threads and said threads shear at said predetermined force to release said setting rod from said shoe.

20. The frac plug according to claim 11, wherein said setting rod is secured to said shoe with a weak point which separates at said predetermined force to release said setting rod from said shoe.

* * * * *